US009504903B2

(12) United States Patent
Newman

(10) Patent No.: US 9,504,903 B2
(45) Date of Patent: Nov. 29, 2016

(54) BRAKING APPARATUS FOR A RECREATIONAL RIDING BOARD APPARATUS

(71) Applicant: BRAKEBOARD PTY LTD, Darlington, WA (US)

(72) Inventor: Benjamin John Newman, St. Kilda (AU)

(73) Assignee: BRAKEBOARD PTY LTD, Darlington, Western Australia (AU)

( * ) Notice: Subject to any disclaimer, the term of this patent is extended or adjusted under 35 U.S.C. 154(b) by 10 days.

(21) Appl. No.: 14/398,860

(22) PCT Filed: May 13, 2013

(86) PCT No.: PCT/AU2013/000490
§ 371 (c)(1),
(2) Date: Nov. 4, 2014

(87) PCT Pub. No.: WO2013/170295
PCT Pub. Date: Nov. 21, 2013

(65) Prior Publication Data

US 2015/0114766 A1 Apr. 30, 2015

(30) Foreign Application Priority Data

May 14, 2012 (AU) ..... 2012901969

(51) Int. Cl.

| | |
|---|---|
| ***B60T 5/00*** | (2006.01) |
| ***A63C 17/14*** | (2006.01) |
| ***A63C 17/22*** | (2006.01) |
| *A63C 17/01* | (2006.01) |

(52) U.S. Cl.
CPC ..... *A63C 17/1427* (2013.01); *A63C 17/01* (2013.01); *A63C 17/226* (2013.01); *A63C 17/015* (2013.01); *A63C 2017/1463* (2013.01)

(58) Field of Classification Search
CPC ..... B62K 3/002
USPC ..... 280/87.042, 87.01, 11.27; 188/17, 18 A, 188/72.6, 74
See application file for complete search history.

(56) References Cited

U.S. PATENT DOCUMENTS

| | | | | |
|---|---|---|---|---|
| 4,134,599 | A * | 1/1979 | DiMille | A63C 17/01 188/29 |
| 4,166,519 | A | 9/1979 | Maloney | |
| 4,183,546 | A * | 1/1980 | Heilig | A63C 17/01 280/11.212 |
| 4,595,209 | A | 6/1986 | Tsai | |
| 5,131,511 | A * | 7/1992 | Appleberry | B60T 8/1837 188/176 |
| 6,488,296 | B2 | 12/2002 | Ireton | |
| 6,547,262 | B1 * | 4/2003 | Yamada | A63C 17/01 280/11.28 |
| 6,659,480 | B1 | 12/2003 | Newman | |
| 6,820,881 | B1 | 11/2004 | Berry | |
| 2006/0032682 | A1 * | 2/2006 | Hillman | A63C 17/12 180/65.1 |
| 2006/0213711 | A1 * | 9/2006 | Hara | A63C 17/0033 180/181 |
| 2010/0314851 | A1 | 12/2010 | Palmer et al. | |
| 2013/0093151 | A1 * | 4/2013 | Falanga | F16D 55/226 280/87.042 |
| 2015/0101892 | A1 * | 4/2015 | Haddleton | A63C 7/108 188/24.11 |

* cited by examiner

*Primary Examiner* — Christopher Schwartz
(74) *Attorney, Agent, or Firm* — Sherrill Law Offices, PLLC

(57) ABSTRACT

Disclosed is a braking apparatus for a recreational wheeled board apparatus such as a skate board. The braking apparatus comprising braking members slidably mounted on an axle, wheel mounting assemblies, a trigger assembly and an actuating means. The braking assembly characterized in that the actuating means comprises opposed first and second actuating levers arranged to provide a balanced force to each of the braking members such that even braking of both wheel mounting assemblies is affected when the trigger assembly is engaged.

18 Claims, 8 Drawing Sheets

BRAKING APPARATUS FOR A RECREATIONAL RIDING BOARD APPARATUS

FIELD OF THE INVENTION

The present invention relates to a braking apparatus for a wheeled recreational riding board apparatus, for instance a skateboard.

Skateboards normally consist of a board for supporting a user, a set of front wheels connected to trucks mounted on the underside of the board, a set of rear wheels connected to trucks mounted on the underside of the board.

Skateboards are commonly used as toys by children and increasingly for recreational and sporting uses by adults.

Such boards are normally controlled by the user by shifting their weight upon the board to cause the board to manoeuvre. Braking on typical skateboards is accomplished by lifting the front of the board from the ground until such time as the back of the board contacts the surface that the board is being ridden on or by the user placing their foot upon the ground. As such skateboards do not include arrangements for safe and controlled braking.

Australian Patent Application 2000059553 and U.S. Pat. No. 6,659,480 by the same inventor details a skateboard brake system. Issues such as the lack of brake balance between respective wheels when the brakes are engaged or the fact that driving the wheels backwards whilst the brake was engaged would cause threaded portions within the braking apparatus to disengage have been identified. The present invention attempts to overcome at least in part the aforementioned disadvantages of this and other previous skateboard braking systems.

SUMMARY OF THE PRESENT INVENTION

In accordance with one aspect of the present invention there is provided a braking apparatus for a recreational wheeled board apparatus comprising braking members slidably mounted on an axle, wheel mounting assemblies, a trigger assembly and an actuating means, characterised in that the actuating means comprises opposed first and second actuating levers arranged to provide a balanced force to each of the braking members such that even braking of both wheel mounting assemblies is affected when the trigger assembly is engaged.

Preferably, the wheel mounting assemblies comprise a wheel, a braking member and a locking-nut fixedly connected to the braking member by fasteners passing within the central portion of the wheel.

Preferably, the wheel mounting assemblies further comprise a bush mounted at a distal end thereof.

Preferably, the relative durometer of the bush is between 25 and 125.

Even more preferably, the relative durometer of the bush is between 50 and 100.

Preferably, the trigger assembly comprises an upper and a lower pedal portion with a pin acting to engage the actuating levers.

Preferably, the trigger assembly further comprises a centrally disposed actuating member.

Preferably, the upper pedal portion and the pin are integrally formed.

Preferably, the length of the pin may be varied to change the force required on the trigger mechanism to affect braking.

Preferably, the trigger assembly comprises a resistance bush.

Preferably, the relative durometer of the resistance bush is in a range between 25 and 125.

Even more preferably, the relative durometer of the resistance bush is in a range between 50 and 100.

Preferably, the trigger assembly is arranged to be engaged by a user's hand.

Preferably, the braking assembly further comprises springs for biasing the braking members toward each other.

Preferably, the axle is afforded a notched portion for engaging a complementary shaped portion in the braking member.

Preferably, the axle is afforded a raised portion for engaging a complementary shaped portion in the braking member.

BRIEF DESCRIPTION OF THE DRAWINGS

The present invention will now be described, by way of example, with reference to the accompanying drawings, in which.

DESCRIPTION OF THE INVENTION

Figure 1:
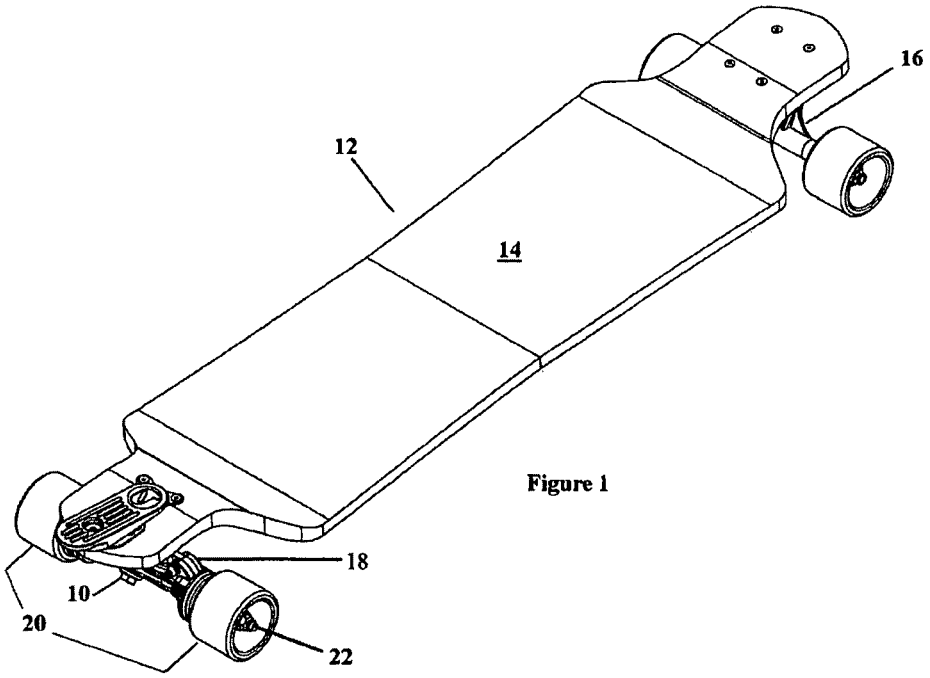
FIG. 1 is a perspective view of a skateboard fitted with a braking assembly in accordance with the present invention.

Referring to the Figures, there is shown a braking apparatus for a recreational riding board 10 mounted to a skateboard 12 having a front end and a rear end. The skateboard 12 comprises a board member 14 having an upper surface and a lower surface, a front wheel assembly 16 flexibly connected to the lower surface of the board member 12 at a first pivot joint and a rear wheel assembly 18 flexibly connected to the lower surface of the board member 14 by a second pivot joint.

The front wheel assembly 16 comprises two front wheels mounted on a front axle such that the front wheels are rotatable in use. The rear wheel assembly 18 comprises two rear wheels 20 mounted on a rear axle 22, such that the rear wheels 20 are rotatable in use.

In accordance with a preferred embodiment of the present invention, braking assembly 10 is mounted as a replacement for the rear wheel assembly 18. The braking assembly 10 comprises a wheel mounting assembly 24, a braking member 26, actuating means 28 and a housing 30.

Figure 2:
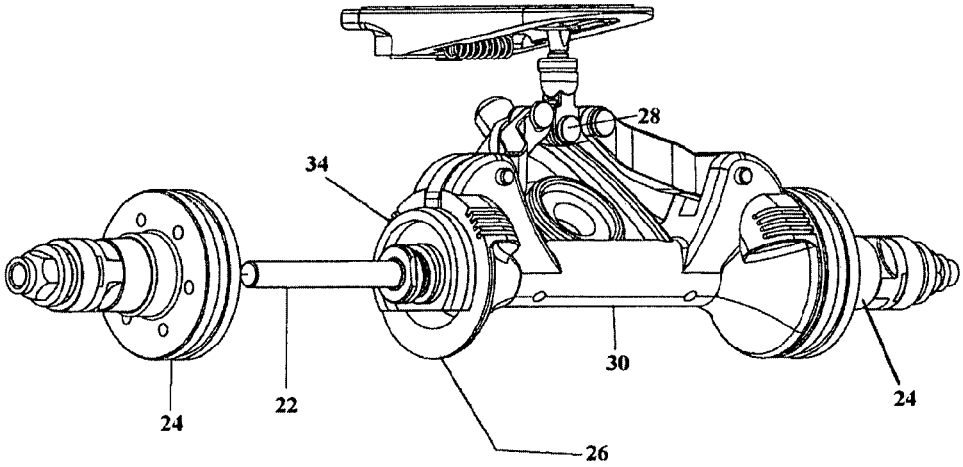
FIG. 2 is a lower perspective view of the braking assembly of FIG. 1, with the wheel mounting assembly exploded for detail.
Figure 3:
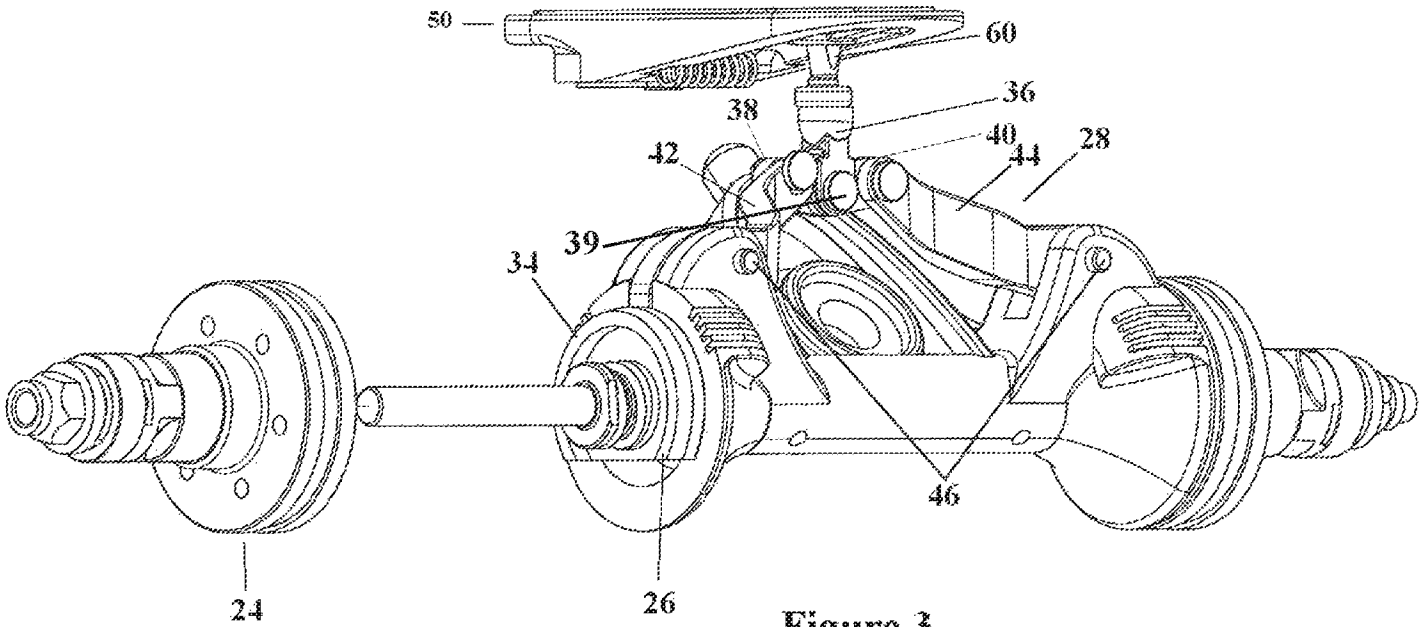
FIG. 3 is a lower perspective view of the braking assembly of FIG. 1, with the wheel mounting assembly exploded for detail.

The braking assembly 10 is shown more particularly in FIGS. 2 and 3. The braking assembly 10 comprises a housing portion 30, two wheel mounting assemblies 24 rotatably mounted on a axle 22, two braking members 26 slidably mounted on the axle 20 and reciprocally movable along the axle 20, and actuating means 28 which, when actuated by the user, urges the braking members 26 to move substantially parallel to the axle 22 away from each other and towards wheel mounting assemblies 24 of the braking assembly 10.

Each braking member 26 is annularly disposed around the rear axle 22, and includes a generally cylindrical first portion having a notched portion 32 for facilitating engagement with actuating means 28, arranged on an outwardly facing side is a circumferentially disposed braking surface 34 which tapers downwardly towards the adjacent wheel mounting assembly.

It should be appreciated that the braking surface 34 has been described in this particular embodiment as downwardly tapering, the braking surface 34 may be substantially flat with the braking member 26 taking the overall shape of a disc.

The actuating means 28 comprises a centrally disposed actuating member 36 and opposed first 38, 40 and second actuating levers 42, 44. The first actuating levers 38, 40, at a proximal end thereof, are attached to the actuating member 36 at a pivot connection 39, and to a respective second actuating lever 42, 44 at a distal end thereof. The second actuating levers 42, 44 are pivotally mounted to the housing 30 of the braking apparatus 10 at a pivot connection 46. The distal end of the second actuating lever 42, 44 engages with the notched portion 32 of respective braking members 26 so as to control motion of the braking member 26 relative the adjacent braking portion 26.

In accordance with another preferred embodiment of the present invention, the axle 22 is afforded a notched portion which engages with a complementary shaped portion in the braking member 26 as to prevent rotation of the braking members 26 relative the wheel mounting assemblies 24.

In accordance with yet another preferred embodiment of the present invention, the axle 22 is afforded a raised portion which is arranged to engage a complementary shaped portion of the braking members 26, therein preventing rotation of the braking member 26 relative to the wheel mounting assembly 24.

Figure 4:
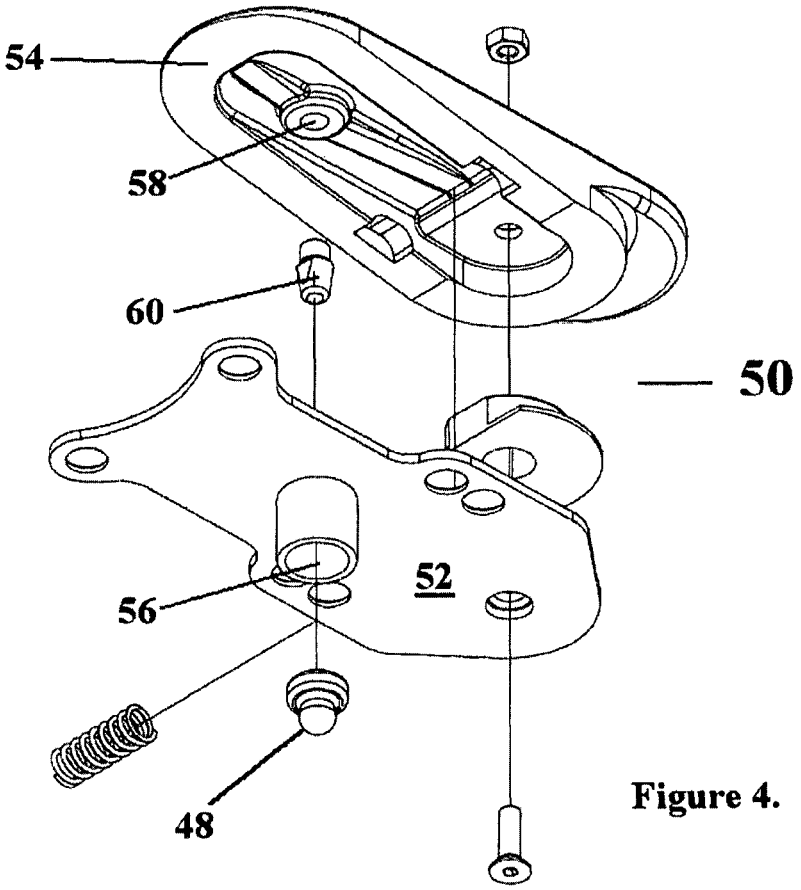
FIG. 4 is an exploded view of the trigger mechanism of the braking assembly of FIG. 1.

The actuating means 28 further comprises a plunger 48, as well as a triggering mechanism 50 comprising a lower pedal portion 52 and an upper pedal portion 54 rotatable relative to the lower pedal portion 52. The upper pedal portion 54 and the lower pedal portion 52 are shown more particularly in FIG. 4.

The lower pedal portion 52 is affixed to the upper surface of the board member 14 by any suitable fixing means, for example by screws. The lower pedal portion 52 comprises a first aperture 56 which is arranged to receive the actuating member 28 and plunger 48.

The upper pedal portion 54 comprises an aperture 58 located in the underside thereof, arranged in use, adjacent to the first aperture 56 of the lower pedal portion 52. A pin 60 is received by the aperture 58, the pin 60 is arranged to pass through the first aperture 56 in the lower pedal portion 52 and engage with the plunger 48.

Figure 6:
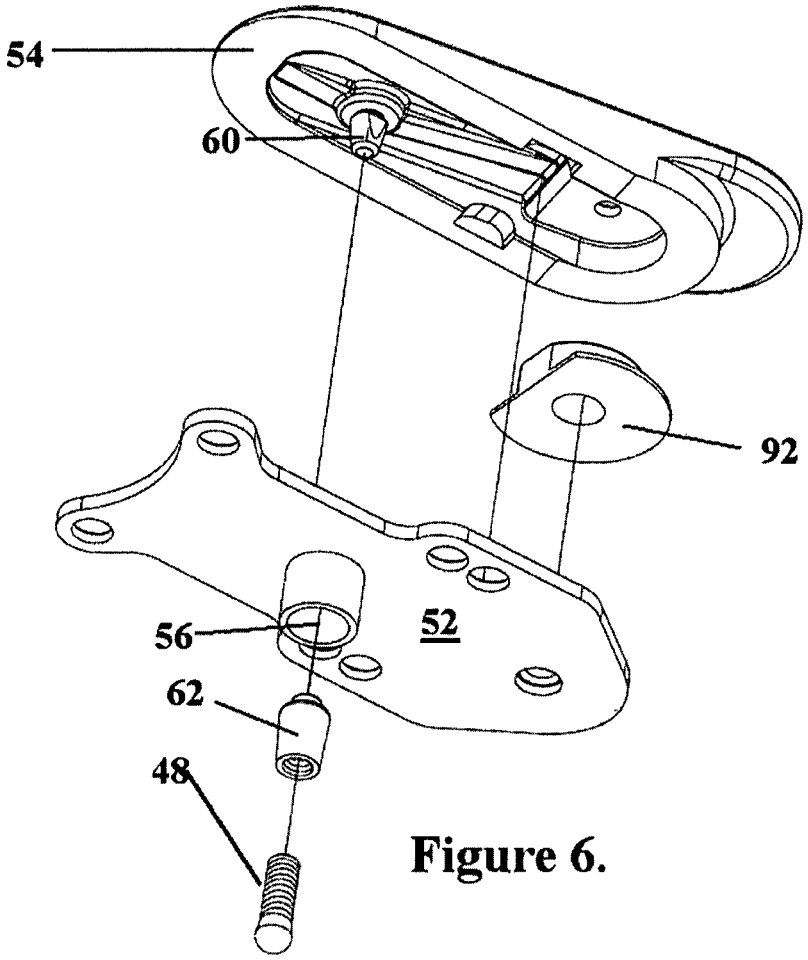
FIG. 6 is an exploded view of the trigger mechanism in accordance with an alternative embodiment of the present invention.
Figure 7:
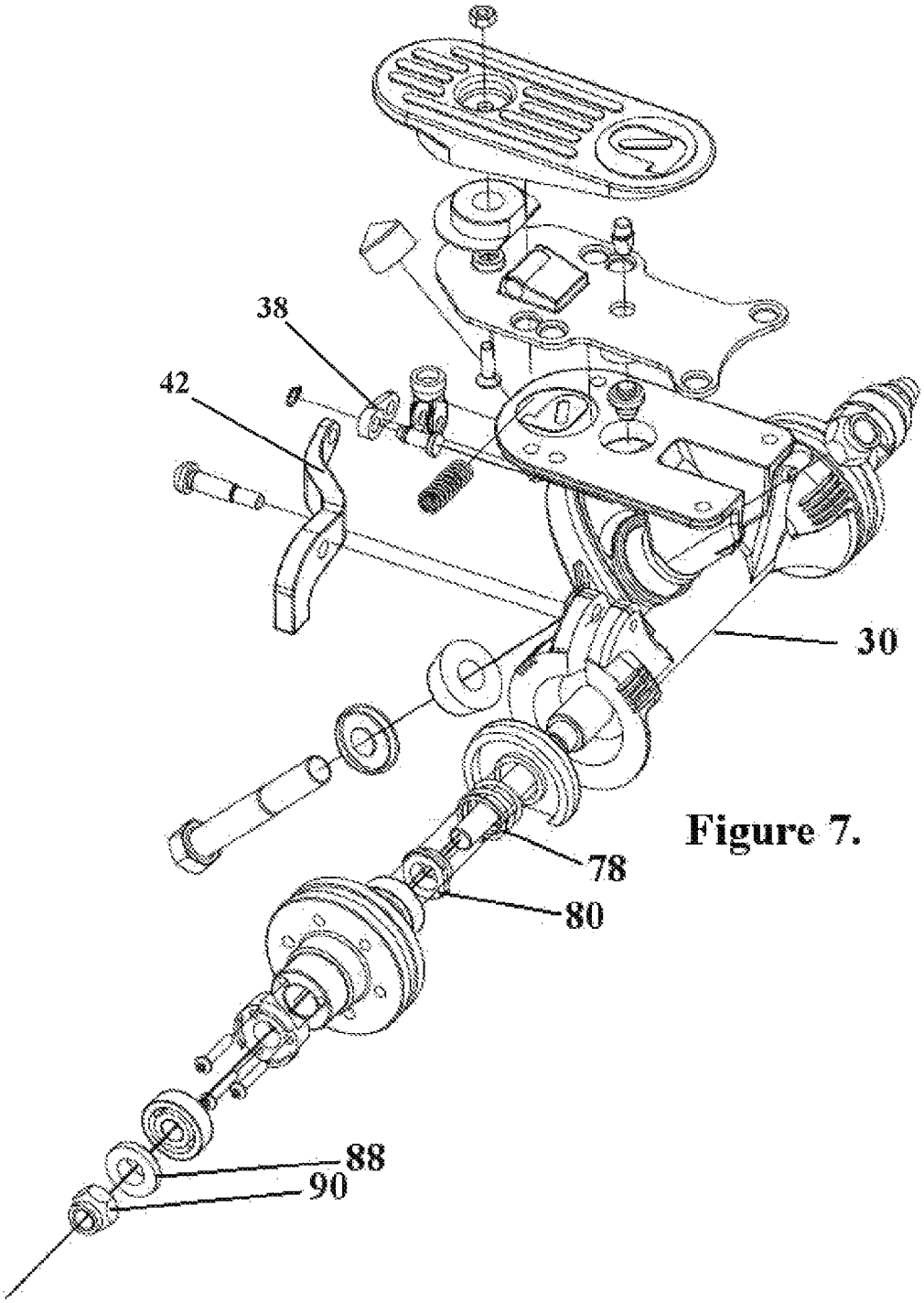
FIG. 7 is an exploded view of the brake assembly of FIG. 1.
Figure 8:
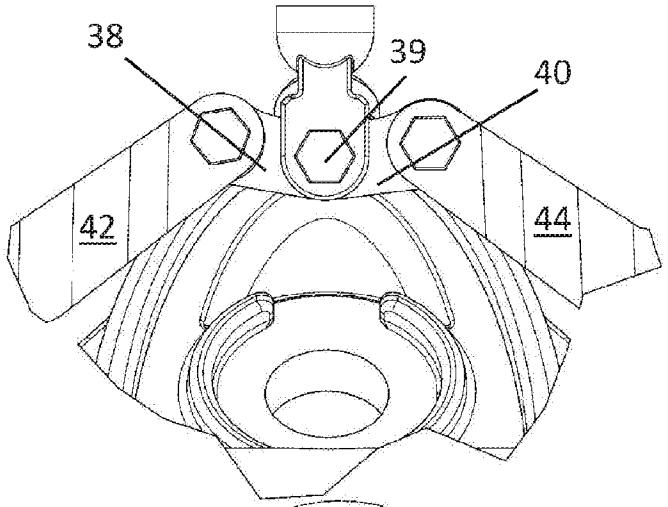
FIG. 8 is an enlarged front view of a portion of the central portion of the braking assembly of FIG. 9.
Figure 9:
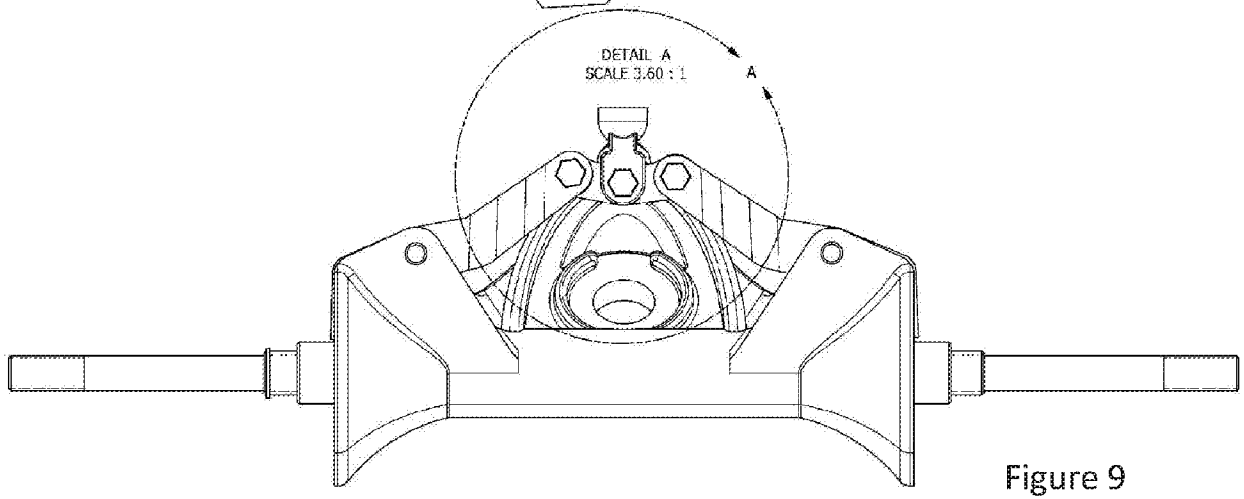
FIG. 9 is a front view of a central portion of the braking assembly of FIG. 3.

In accordance with another preferred embodiment of the present invention, and as shown in FIG. 6 the pin 60 is formed integrally with the upper pedal portion 54.

In accordance with yet another preferred embodiment of the present invention, the plunger 48 and the actuating member 28 are formed integrally with the upper pedal portion 54.

In accordance with yet another preferred embodiment of the present invention and as shown in FIG. 6, the plunger 48 may be adjustable in length with the relative length of the plunger 48 being adjusted by inter-engagement with a thread collar portion 62.

In accordance with even yet another preferred embodiment of the present invention, the plunger 48 and the actuating member 28 are formed as a single component that is received by the aperture 58 of the upper pedal portion 54.

Figure 5:
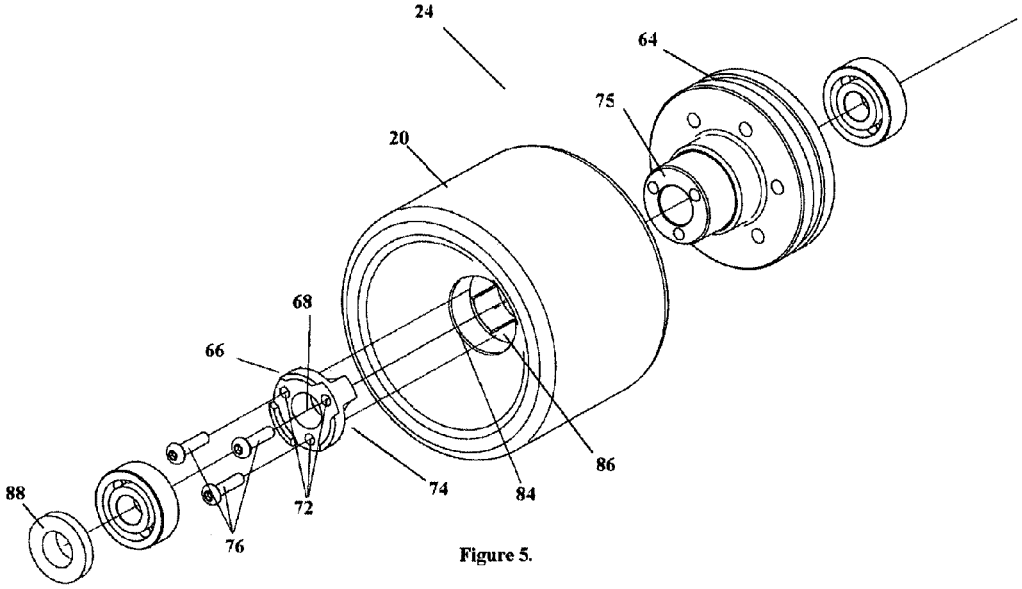
FIG. 5 is an exploded view of the wheel mounting assembly of the braking assembly of FIG. 1.

Shown more particularly in FIG. 5, each wheel mounting assembly comprises a braking member 64 arranged to engage braking member 26 and a notched locking nut 66 which is adapted to engage and secure a wheel 20 there between.

The notched locking nut 66 comprises a centrally disposed aperture 68 and an abutment portion 70; afforded in the abutment portion 70 are a plurality of concentrically disposed apertures 72 and notched portions 74. In use, a wheel 20 is arranged to be mounted on the braking member 64 such that the distal end of the brake drum 64 is in close abutting contact with the internal surface of the wheel 20. The notched locking nut 66 is placed in contact with the opposing side of the wheel 20 and suitable fasteners 76, such as threaded screws, are passed through the concentrically disposed apertures 72 to fixedly connect the notched locking nut 66 and the braking member 64, thereby rotatably restraining the wheel 18 between the notched locking nut 64 and the braking member 62.

The arrangement as described above has been found to be an improvement over other wheel mounting means such as those described in Australian Patent Application 200059553, wherein movement of the wheel in a backward direction whilst the brake was engaged would result in the threaded portions of the wheel mounting means disengaging and the wheel no longer being restrained as intended.

Also provided are springs 78 for biasing the braking members 28 towards each other and thereby urging the actuating member 28 in an upward direction. The springs 78 are disposed annularly about the axle 20 adjacent the cylindrical portion of the braking member 28. The springs 78 are restrained at an end remote of the braking member 28 by an end cap 80 which locates, in use, adjacent a bearing 82 of the adjacent wheel mounting assembly 24.

In accordance with a preferred embodiment of the present invention, the wheel 20 further comprises a bearing shoulder 84 within a centrally disposed aperture. Preferably the bearing shoulder 84 further comprises a plurality of notches 86 that engage with notched portions 74 of the notched locking nut 72 in a complementary manner, the inter-engagement of the notched portions 74 and notches 86 further rotatably restraining the wheel 20 to the notched locking nut 72.

In accordance with another preferred embodiment of the present invention, the braking member 64 further comprises a notched extension extending from end distal to the brake member 28. The wheel 20 is arranged to have the notched extension of the braking member 62 inserted through the centrally disposed aperture of the wheel 20, such that the notched portion 74 passes through the centrally disposed aperture before engaging with the plurality of notches 86, therein substantially preventing the notched extension from passing back through the centrally disposed aperture.

Each adjacent wheel mounting assembly also includes a bush 88 and a wheel nut 90 for fixing the respective wheel mounting assemblies 24 on the axle 20. It has been discovered that by choosing a bush 88 with a specific durometer rating it is possible to change the braking characteristics of the braking apparatus 10 in a beneficial manner. It has been found that the lower the durometer rating of the material used the less effective the overall braking power of the device is.

In accordance with a preferred embodiment of the present invention the bush 88 is manufactured as a molded piece of urethane or nylon material. However, it should be appreciated that any number of materials or manufacturing technique may be employed in creating the bush 88. Regardless of the material of method of manufacture used to create the bush 88 the relative durometer of the bush is the important aspect.

Preferably a bush 88 with a relative durometer rating of between 25 and 125 is used. Even more preferably bush 88 with a relative durometer of between 50 and 100 will be used. It has been discovered that using a bush 88 with a relative durometer as described above gives the wheel braking portion 22 an anti-brake skidding like effect, wherein having the wheel 'lock' in a single position is prevented when the brake is applied.

Shown in FIG. 6 is a resistance bush 92, the resistance bush 92 is arranged between the upper pedal portion 54 and the lower pedal portion 52, such that pressure on the upper pedal portion 54 causes the resistance bush 92 to compress. It has been found that by varying the durometer of the resistance bush 92, the 'braking feel' of the braking mechanism can be controlled. As well as the durometer of the resistance bush 92 being chosen to give a certain 'braking feel' the initial tension under which the resistance bush 92 is held has a direct effect on braking feel, with high initial tensions producing a harder 'feeling' brake.

In use, a rider of the skateboard 12 stands on the upper surface of the board member 14 so that feet of the user extend in a direction substantially parallel to the axle 20 and one foot lies on or adjacent to the trigger mechanism 50.

The trigger mechanism 50 is arranged to have a first and a second position, wherein the upper 54 and lower pedal portion 52 are rotatable relative to each other. In a first position of the trigger mechanism 50 the wheel mounting portion 24 is not engaged and the pin 60 is forced upward into the aperture in the underside of the upper pedal portion 54 through the action of the springs 78. In this first position, the pin 78 is prevented from moving downward and placing pressure on the plunger 48.

It will be appreciated that since the upper pedal portion 52 is biased towards the first position wherein the braking members 28 are biased away from the wheel mounting assemblies 60, the wheels 18 are free to move substantially free of restriction whilst the trigger mechanism 48 is in a first position.

In a second position of the trigger mechanism 50 the upper pedal portion 54 is rotated to align with the lower pedal portion 52. The upper 54 and lower pedal portion 52 aligning allows the pin 58 to engage with the plunger 48, causing the plunger 48 to move downward. Downward movement of the plunger 48 causes downward movement of the actuating member 36. This downward motion causes first actuating levers 38, 40 and second actuating levers 42, 44 to pivot relative each other, wherein distal ends of the second actuating levers 42, 44 urge braking members 26 outward towards the respective wheel mounting assemblies 24.

When the rider decides to reduce the speed of movement of the skateboard 12, the user moves the foot located on or adjacent the trigger mechanism 50 rotating the upper pedal portion 54 relative to the lower pedal portion 52, thereby causing the trigger mechanism 50 to move from its first position to its second position.

This, in turn, causes the actuating member 36 to move in a downwardly direction through the collar member 94, causing each of the actuating levers 38, 40 to pivot about a pivot connection 46 in a first rotational direction, therein causing pivoting in the opposing direction of respective second actuating levers 42, 44 urging the braking members 26 to move away from each other.

As a result, the outwardly facing circumferential braking surfaces 34 of the braking members 26 contact the inwardly facing circumferential braking member 64 of the wheel mounting assemblies 24 causing braking of the wheel mounting assemblies 24 of the wheels 20 to be affected.

Once satisfactory braking has been achieved, the rider rotates the upper pedal portion 54 so as to cause the upper pedal portion 54 to return to the first position therein causing the pin 58 to retract. As a result, the force provided by the spring 78 urges the braking members 28 to move towards each other causing the actuating levers 38, 40 to pivot forcing the actuating member 36 to move in an upward direction.

In accordance with a preferred embodiment of the present invention, the trigger mechanism 50 may be arranged to remain in a second position awaiting the user placing there foot upon the upper pedal portion 54 to engage the braking assembly 10.

It will be understood that the degree of braking achieved by the above described downward movement of the actuating means 28 is adjustable by adjusting the position of the plunger 48 relative to the actuating means 28, and by varying the length of the first actuating levers 38, 40.

It should further be understood that the first actuating levers 38, 40 and second actuating levers 42, 44 are able to pivot independently to each other. In this manner it has been found that such an arrangement causes the forces applied to the braking members 26 to be balanced between the two sets of actuating levers 42, 44 such that balanced braking of the wheel mounting assemblies 24 occurs.

It will also be appreciated that the invention is also applicable to other recreational articles having the general configuration of a board supported by pairs of wheels, such other articles including street luges wherein a rider lies on the board in use. With this type of article the upper pedal portion 54 is actuated by a hand of a rider instead of a foot.

Furthermore, it will be appreciated that although the above embodiment has been described in relation to a braking apparatus provided at a rear portion of a skateboard or like article, the braking apparatus may alternatively be provided at a front portion of the skateboard or like article.

Modifications and variations as would be apparent to a skilled addressee are deemed to be within the scope of the present invention.

The invention claimed is:

1. A braking apparatus for a recreational wheeled board apparatus comprising braking members slidably mounted on an axle, wheel mounting assemblies, a trigger assembly and an actuating means, characterised in that the actuating means comprises a first set of actuating levers and an opposed second set of actuating levers, each of the first set of actuating levers and the second set of actuating levers providing an independent pivot point interposed between the trigger assembly and the braking members, thereby being arranged to provide a balanced force to each of the braking members, such that even braking of both wheel mounting assemblies is affected when the trigger assembly is engaged.

2. A braking apparatus in accordance with claim 1, characterised in that the wheel mounting assemblies comprise a wheel and a locking nut fixedly connected to the braking member by fasteners passing within the central portion of the wheel.

3. A braking apparatus in accordance with claim 1, characterised in that the wheel mounting assemblies further comprise a bush mounted at a distal end thereof.

4. A braking apparatus in accordance with claim 3, characterised in that the relative durometer of the bush is between 25 and 125.

5. A braking apparatus in accordance with claim 4, characterised in that the relative durometer of the bush is between 50 and 100.

6. A braking apparatus in accordance with claim 1, characterised in that the trigger assembly comprises an upper and a lower pedal portion with a pin acting to engage the actuating levers.

7. A braking apparatus in accordance with claim 6, characterised in that the trigger assembly further comprises a centrally disposed actuating member.

8. A braking apparatus in accordance with claim 6, characterised in that the upper pedal portion and the pin are integrally formed.

9. A braking apparatus in accordance with claim 6, characterised in that the length of the pin may be varied to change the force required on the trigger mechanism to affect braking.

10. A braking apparatus in accordance with claim 1, characterised in that the trigger assembly comprises a resistance bush.

11. A braking apparatus in accordance with claim 10, characterised in that the relative durometer of the resistance bush is in a range between 25 and 125.

12. A braking apparatus in accordance with claim 10, characterised in that the relative durometer of the resistance bush is in a range between 50 and 100.

13. A braking apparatus in accordance with claim 1, characterised in that the trigger assembly is arranged to be engaged by a user's hand.

14. A braking apparatus in accordance with claim 1, characterised in that the braking apparatus further comprises springs for biasing the braking members toward each other.

15. A braking apparatus in accordance with claim 1, characterised in that the axle is afforded a notched portion for engaging a complementary shaped portion in the braking member.

16. A braking apparatus in accordance with claim 1, characterised in that the axle is afforded a raised portion for engaging a complementary shaped portion in the braking member.

17. A braking apparatus for a recreational wheeled board apparatus comprising braking members slidably mounted on an axle, wheel mounting assemblies, a trigger assembly and a pair of actuator sets, characterised in that the pair of actuator sets comprise a first set of actuating levers and an opposed second set of actuating levers, the first set of actuating levers and the second set of actuating levers each comprising two actuating levers providing a single independent pivot point interposed between the trigger assembly and the braking members, thereby being arranged to provide a balanced force to each of the braking members, such that even braking of both wheel mounting assemblies is affected when the trigger assembly is engaged.

18. A braking apparatus for a recreational wheeled board apparatus comprising braking members slidably mounted on an axle, wheel mounting assemblies, a trigger assembly and a pair of actuator sets, characterised in that the pair of actuator sets comprise a first set of actuating levers and an opposed second set of actuating levers, the first set of actuating levers and the second set of actuating levers each comprising more than two actuating levers providing multiple independent pivot points interposed between the trigger assembly and the braking members, thereby being arranged to provide a balanced force to each of the braking members, such that even braking of both wheel mounting assemblies is affected when the trigger assembly is engaged.

* * * * *